US008734168B2

(12) United States Patent
Lee et al.

(10) Patent No.: US 8,734,168 B2
(45) Date of Patent: May 27, 2014

(54) SAFETY PLUG ADAPTER

(75) Inventors: Chiu-San Lee, New Taipei (TW); Su-Chen Shen, New Taipei (TW); Yi-Hsun Lee, New Taipei (TW)

(73) Assignee: XYZ Science Co., Ltd., New Taipei (TW)

( * ) Notice: Subject to any disclaimer, the term of this patent is extended or adjusted under 35 U.S.C. 154(b) by 136 days.

(21) Appl. No.: 13/563,748

(22) Filed: Aug. 1, 2012

(65) Prior Publication Data

US 2014/0038439 A1 Feb. 6, 2014

(51) Int. Cl.
*H01R 4/66* (2006.01)

(52) U.S. Cl.
USPC ..... 439/95; 439/171

(58) Field of Classification Search
CPC ..... H01R 13/514; H01R 31/06
USPC ..... 439/95, 171, 172, 653
See application file for complete search history.

(56) References Cited

U.S. PATENT DOCUMENTS 4,605,273 A * 8/1986 Horton ..... 439/369
7,052,298 B1 * 5/2006 Cheng ..... 439/171
7,303,416 B1 * 12/2007 Liao ..... 439/173
7,354,286 B1 * 4/2008 Lee ..... 439/172
7,527,508 B1 * 5/2009 Lee et al. ..... 439/137
7,857,640 B1 * 12/2010 Lee et al. ..... 439/137
7,950,938 B1 * 5/2011 Teoh ..... 439/171
8,197,273 B1 * 6/2012 Lee ..... 439/172
2005/0153587 A1 * 7/2005 Hsu et al. ..... 439/171
2012/0171902 A1 * 7/2012 Lee ..... 439/660
2013/0183843 A1 * 7/2013 Lee ..... 439/222
2013/0316589 A1 * 11/2013 Lee ..... 439/653

* cited by examiner

*Primary Examiner* — Amy Cohen Johnson
*Assistant Examiner* — Vladimir Imas
(74) *Attorney, Agent, or Firm* — Leong C. Lei

(57) ABSTRACT

A safety plug adapter comprises a cover, a base plate, a conductive terminal block, a first sliding assembly, a second sliding assembly, two first conductive pins, two second conductive pins, two auxiliary elements, a ground portion, a grounding terminal block, and an attachable conductive pin, wherein the cover defines a first group of slots on a top surface thereof and a second group of slots on a side surface; the first group of slots includes a live slot, a neutral slot, and a ground slot; the second group of slots includes a live slot and a neutral slot. With the plug adapter, the first group of slots or the second group of slots can be inserted by a plug of an electrical device, whereas the first conductive pins or the second conducive pins can insert into a socket, to achieve an electrical connection between the electrical device and the socket.

9 Claims, 17 Drawing Sheets

SAFETY PLUG ADAPTER

TECHNICAL FIELD OF THE INVENTION

The present invention relates to a plug adapter and, more particularly, to a safety plug adapter that that allows connections between various plugs and various sockets without occupying too much space, and can be used conveniently.

DESCRIPTION OF THE PRIOR ART

A Plug adaptor allows a portable device to be connected with a foreign socket, and thus is an indispensable item for travelers. There are some existing plug adapters available in the market. Although they contain complete functions to achieve various connections between plugs and sockets, they are large in volume, which may cause inconvenience in travel.

In view of the disadvantages of the existing adapters, based on the long-term experiences on the related works, the applicant has contrived a safety plug adaptor which allows connections between various plugs and various sockets without occupying too much space.

SUMMARY OF THE INVENTION

The primary object of the present invention is to provide a safety plug adapter that allows connections between various plugs and various sockets without occupying too much space.

The second object of the present invention is to provide a safety plug adapter that can prevent the adapter from being inserted with an improper pin.

To achieve the above objects, the safety plug adapter may comprise a cover, a base plate, a conductive terminal block, a first sliding assembly, a second sliding assembly, two first conductive pins, two second conductive pins, two auxiliary elements, a ground portion, a grounding terminal block, and an attachable conductive pin, wherein the cover defines a first group of slots on a top surface thereof and a second group of slots on a side surface; the first group of slots includes a live slot, a neutral slot, and a ground slot; the second group of slots includes a live slot and a neutral slot.

With the safety plug adapter, the first group of slots or the second group of slots can be inserted by a plug of an electrical device, whereas the first conductive pins or the second conducive pins can insert into a socket with a selective cooperation of the attachable ground pin, to achieve an electrical connection between the electrical device and the socket.

Other objects, advantages, and novel features of the present invention will become more apparent from the following detailed description when taken in conjunction with the accompanying drawings.

DETAILED DESCRIPTION OF THE PREFERRED EMBODIMENTS

Figure 1:
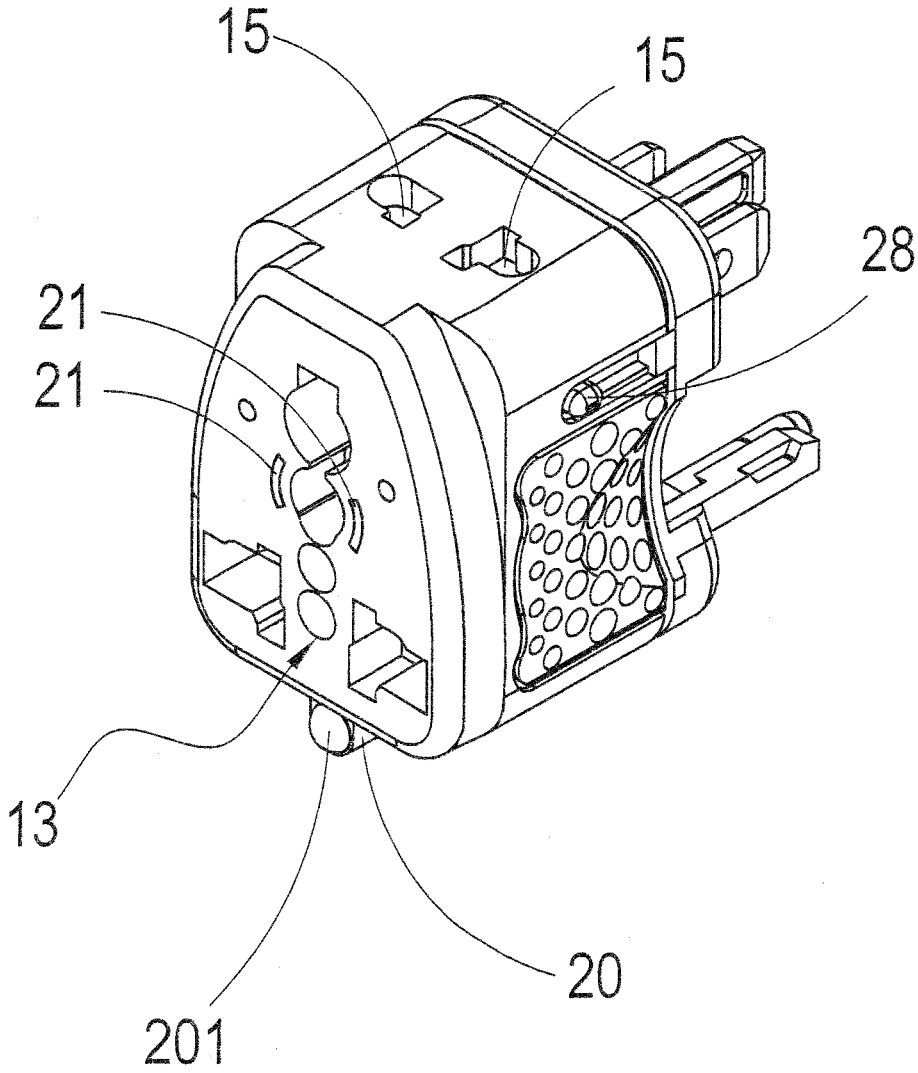
FIG. 1 shows a 3-dimensional view of one embodiment of the present invention.
Figure 2:
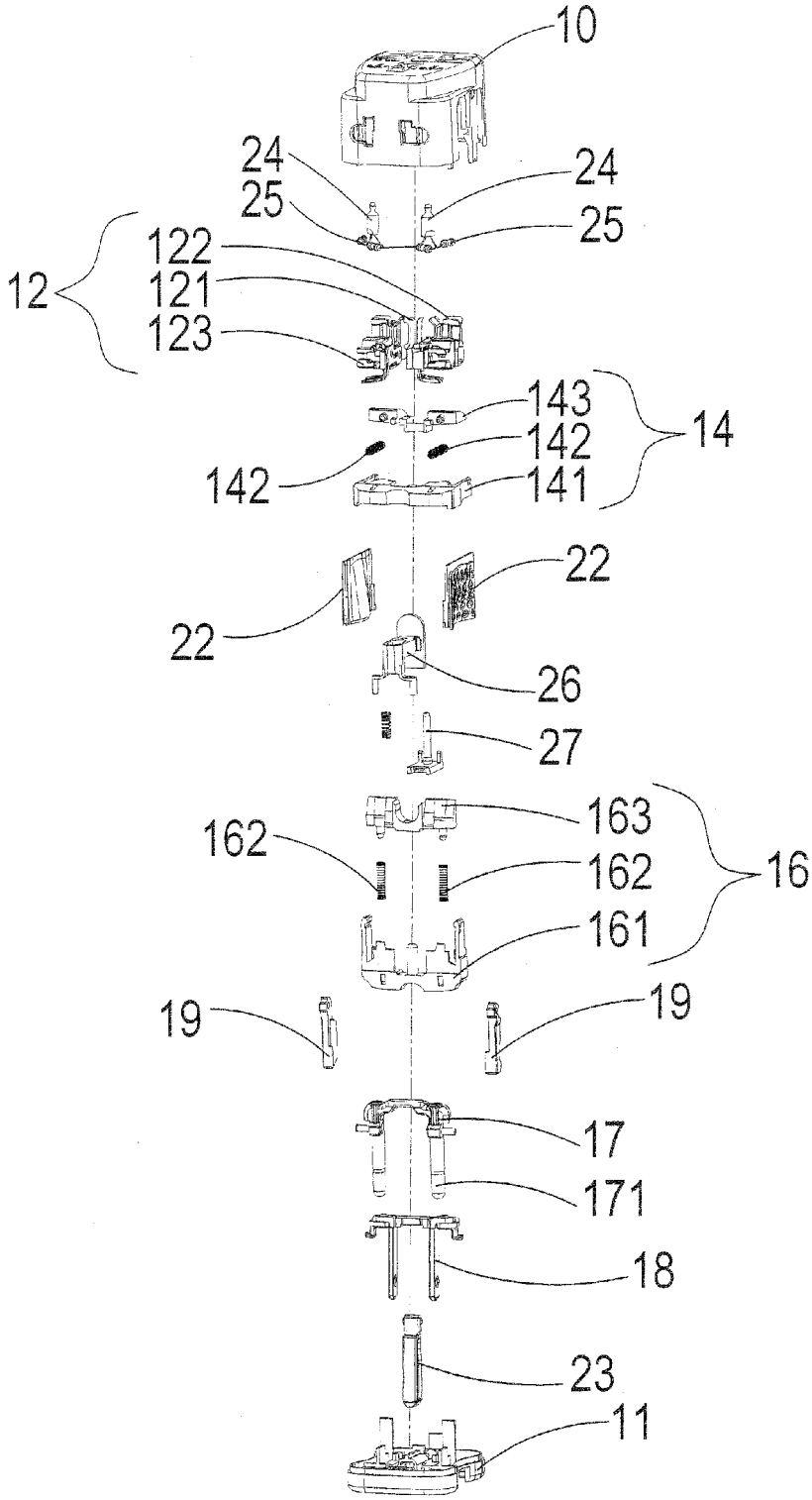
FIG. 2 shows an exploded view of the embodiment of the present invention.
Figure 6:
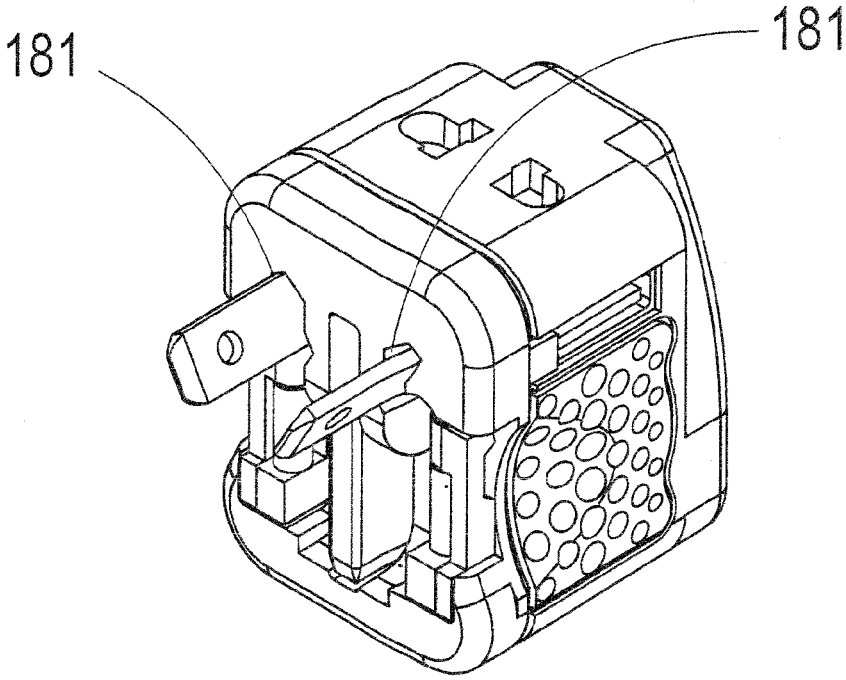
FIG. 6 shows a fifth application view of the embodiment of the present invention.
Figure 6A:
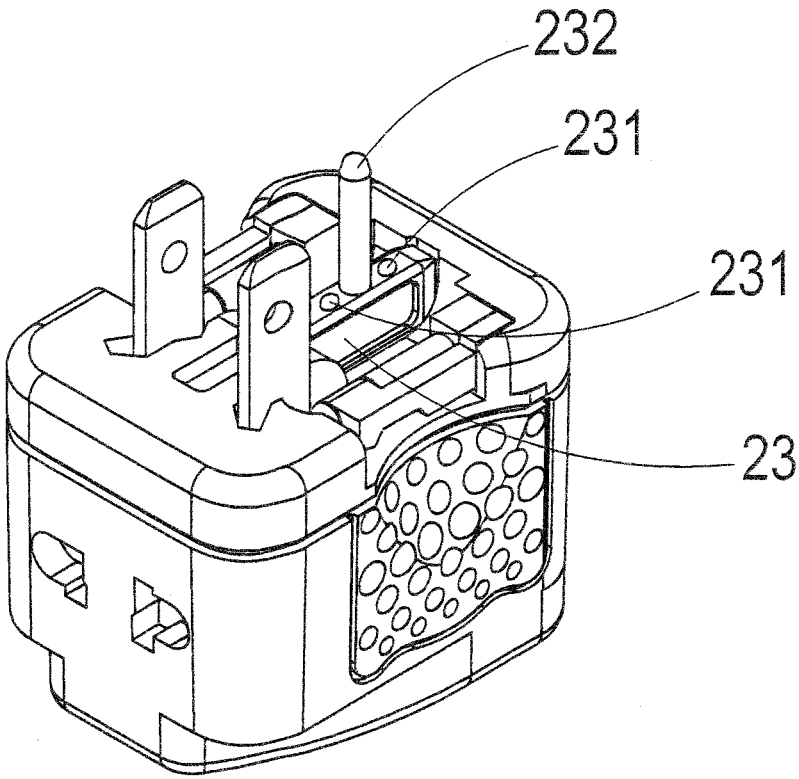
FIG. 6A shows a sixth application view of the embodiment of the present invention.
Figure 6B:
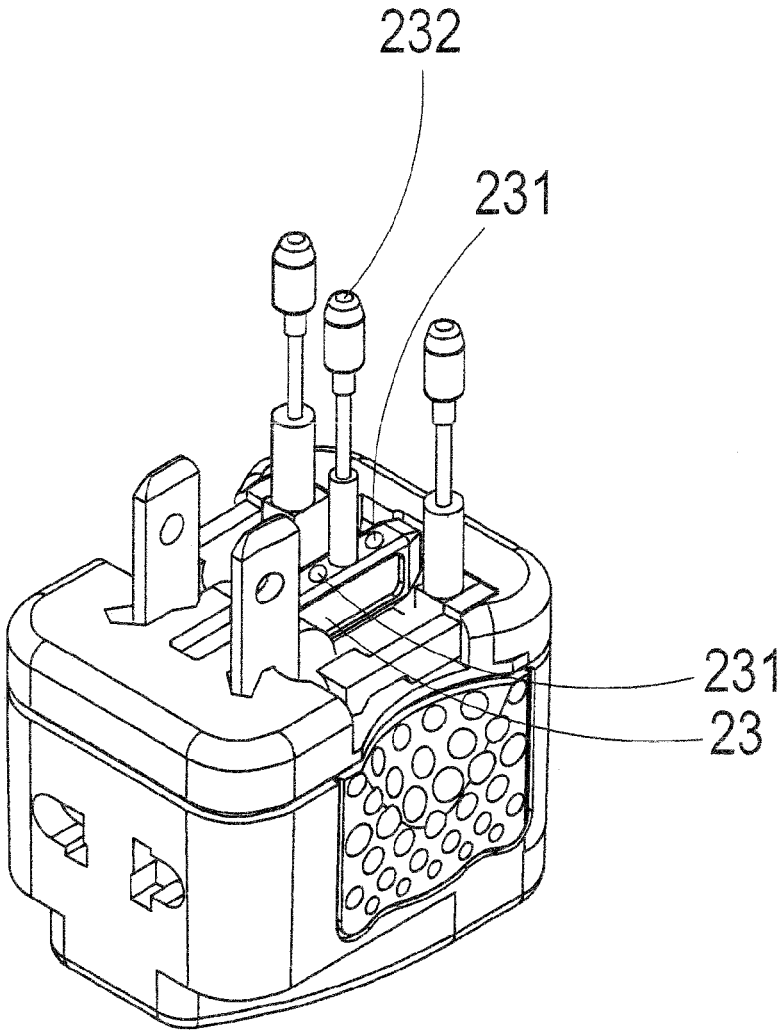
FIG. 6B shows a seventh application view of the embodiment of the present invention.
Figure 6C:
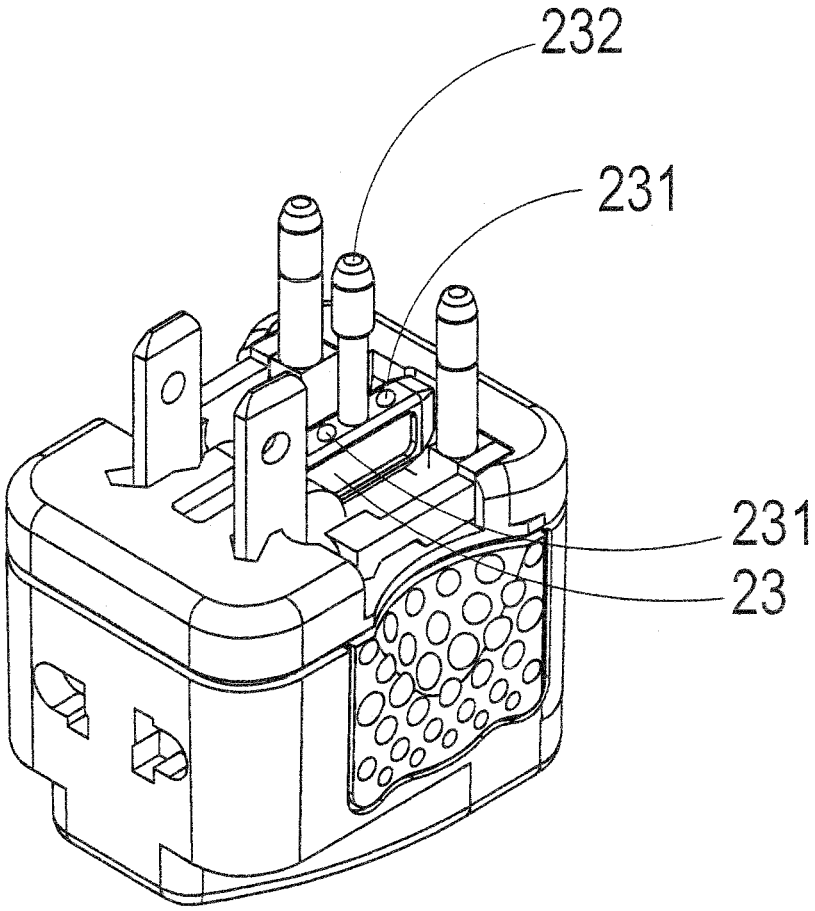
FIG. 6C shows an eighth application view of the embodiment of the present invention.
Figure 6D:
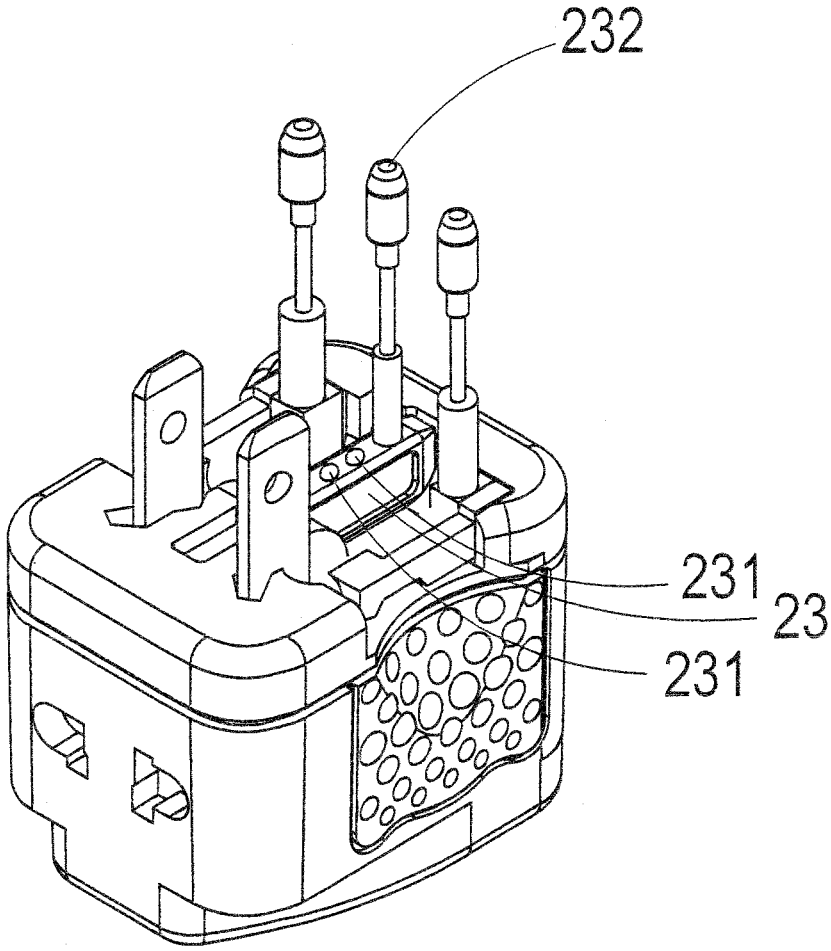
FIG. 6D shows a ninth application view of the embodiment of the present invention.
Figure 6E:
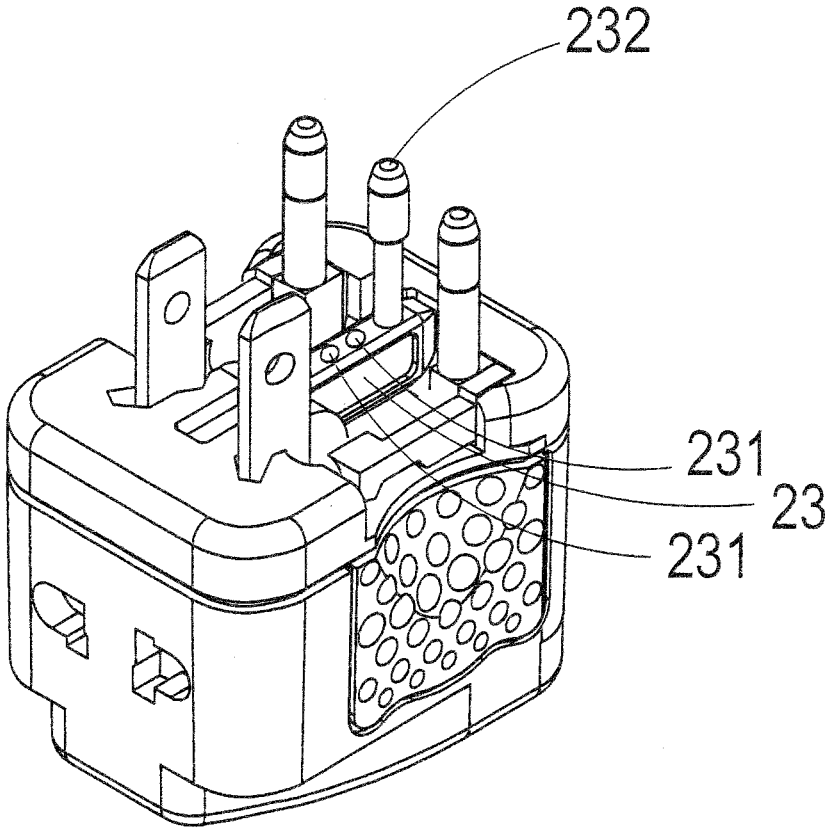
FIG. 6E shows a tenth application view of the embodiment of the present invention.

Referring to FIGS. 1 and 2, a safety plug adapter according to one embodiment of the present invention generally comprises a cover 10, a base plate 11, a conductive terminal block 12, a first sliding assembly 14, a second sliding assembly 16, two first conductive pins 17, two second conductive pins 18, two auxiliary elements 19, a grounding portion 20, a grounding terminal block 23, and an attachable conductive pin 232 (see FIG. 6A).

The cover 10 defines a first group of slots 13 on a top surface thereof and a second group of slots 15 on a side surface, wherein the first group of slots 13 includes a live slot, a neutral slot, and a ground slot 21; the second group of slots 15 includes a live slot and a neutral slot. The base plate 11 can be mated with the cover 10 to form a housing for the adapter. The conductive terminal block 12, which includes a grounding terminal 121, a live terminal 122, and a neutral terminal 123, is mounted in the cover 10, wherein the grounding terminal 121 is located corresponding to the ground slot 21 of the first group of slots 13 on the top surface of the cover 10.

Figure 7:
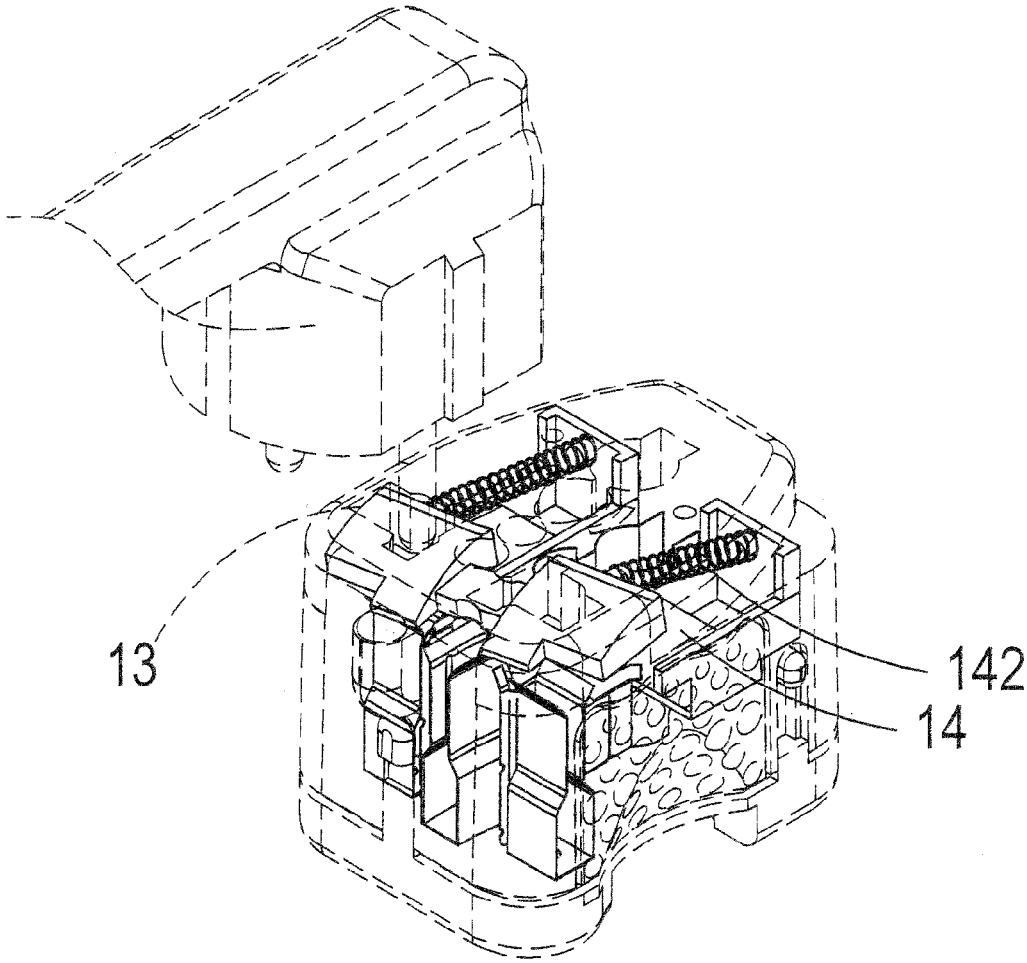
FIG. 7 shows a working view of the first sliding assembly of the embodiment of the present invention.
Figure 7A:
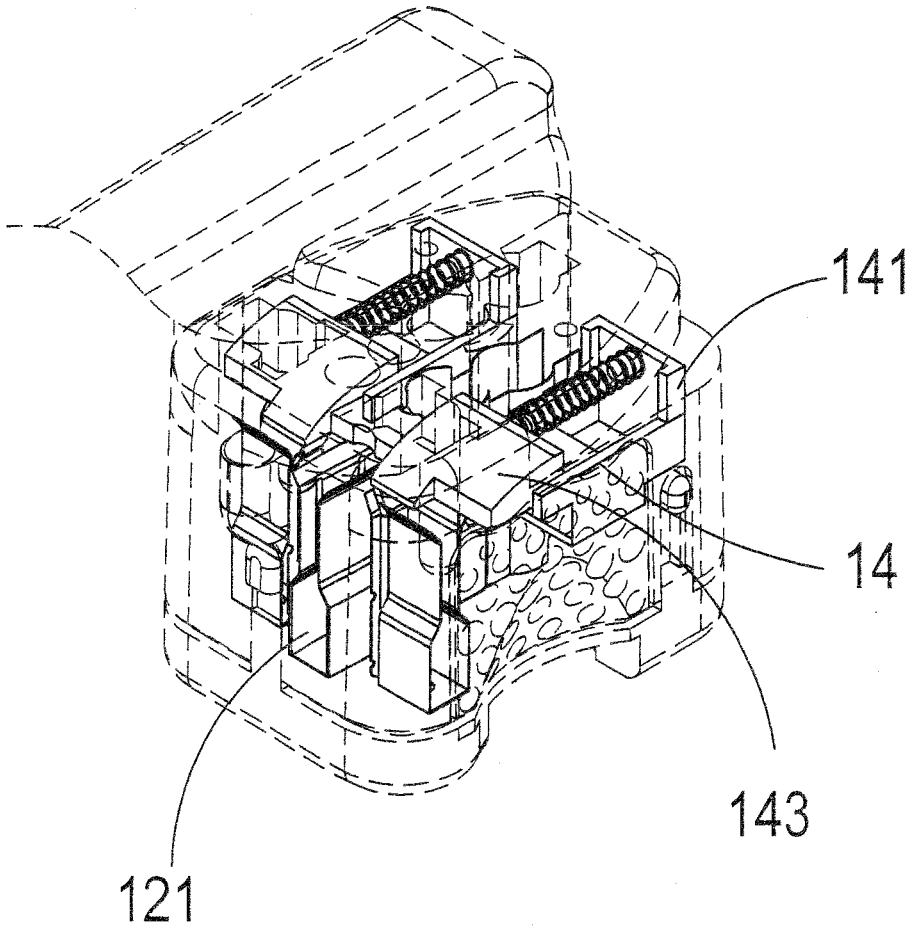
FIG. 7A shows another working view of the first sliding assembly of the embodiment of the present invention.

The first sliding assembly 14 is mounted in the cover 10, corresponding to the first group of slots 13, above the conductive terminal block 12. In more detail, as shown in FIGS. 7 and 7A, the first sliding assembly 14 includes a base element 141 fixedly mounted in the cover 10, a sliding element 143 slidably mounted in the cover 10, and two springs 142 symmetrically connected between the base element 141 and the sliding element 143, so that the sliding member 143 can be normally biased by the two springs 142 to close the live slot and the neutral slot of the first group of slots 13, to enhance the safety of the adapter, as will be fully described later.

The second sliding assembly 16 is mounted in the cover 10, corresponding to the second group of slots 15, beside said conductive terminal block 12. In more detail, the second sliding assembly 16 includes a base element 161 fixedly mounted in the cover 10, a sliding element 163 slidably mounted in the cover 10, and two springs 162 symmetrically connected between the base element 161 and the sliding element 163, so that the sliding member 163 can be normally biased by the springs 162 to close the live slot and the neutral slot of the second group of slots 15, to enhance the safety of the adapter (see also FIGS. 9 and 9A), as will be fully described later.

Figure 3:
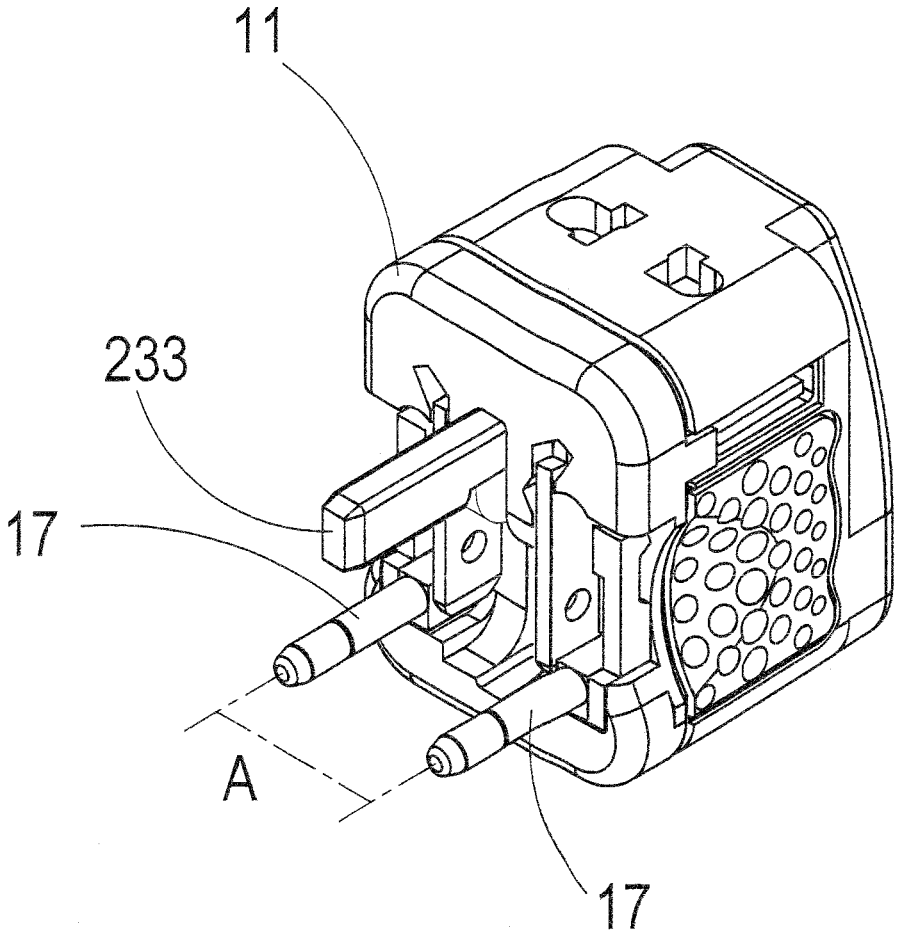
FIG. 3 shows a first application view of the embodiment of the present invention.

As shown in FIG. 3, the two first conductive pins 17 are pivotally mounted at the base plate 11. As shown in FIG. 5, The two second conductive pins 18 are movably mounted at the base plate 11 opposite to the first conductive pins 17. In use, the second conductive pins 18 can be pushed by a pushing element 28, which is provided in the cover 10, to extend out of the base plate 11 for connecting to a socket. Particularly, the first conductive pins 17 can be arranged according to European Standard, whereas the second conductive pins 18 can be arranged according to US standard. Thus, the distance (A) between the first conductive pins 17 is greater than the distance (B) between the second conductive pins 18 (see FIGS. 3 and 5). Furthermore, since a European socket has a recessed shape, to ensure a proper connection thereto, each of the first conductive pins 17 is preferably designed to be an extendable pin. To achieve this purpose, each of the first conductive pins 17 can be provided with an extension portion 171 (see FIG. 4) for increasing the length of each conductive pin, so that the present adapter can be fitted to a European socket properly. Furthermore, when the adapter is not in use, the first conductive pins 17 can be folded to lie on the base plate 11, or the second conductive pins 18 can be pushed back into the cover 10, so that the space occupied by the adapter can be reduced and the possibility of damaging or scratching other objects can be avoided. In addition, the second conductive pins 18 can be formed into an angled pin 181 for connecting to a special socket.

Figure 3A:
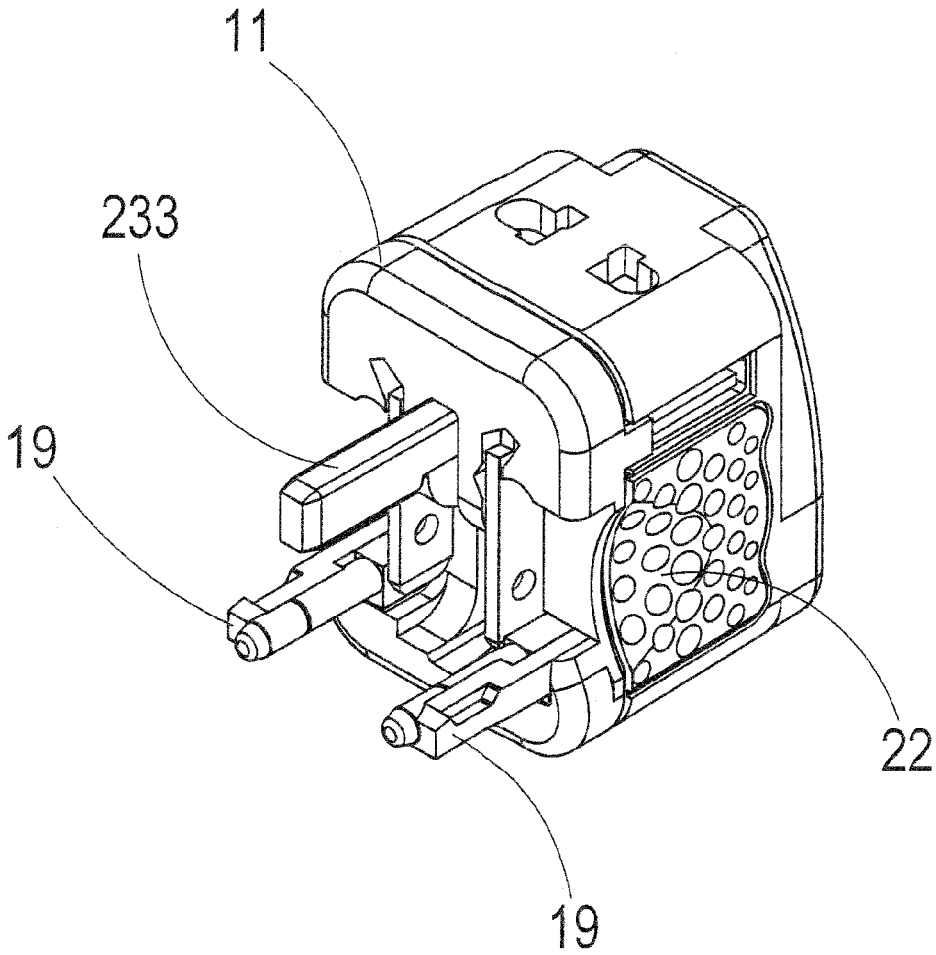
FIG. 3A shows a second application view of the embodiment of the present invention.

As shown in FIG. 3A, two auxiliary elements 19 are provided at the base plate 11 for being selectively combined with the first conductive pins 17 to increase their cross dimensions.

The grounding portion 20 is formed on the cover 10 and located opposite to the ground slot 21 of the first group of slots 13, wherein the grounding portion 20 is provided with a grounding rod 201 being electrically connected to the grounding terminal 121 of the conductive terminal block 12. Particularly, the grounding rod 201 is provided in a movable manner that allows a ground pin of a plug to be engaged with the grounding rod 201. Thus, a plug may connect to the adapter in two opposite orientations, wherein the ground pin of the plug can insert into the ground slot 21 or the ground portion 20. This feature may facilitate electrical connection.

Furthermore, as shown in FIG. 3A, a grip portion 22 can be provided on two opposite sides of the cover 10 for ease of taking the adapter.

As shown in FIGS. 6A, 6B, 6C, 6D and 6E, the grounding terminal block 23 is mounted at the base plate 11 and defining a plurality of attachment holes 231. Also, the grounding terminal block 23 is electrically connected to the grounding terminal 121 of the conductive terminal block 12. One of the attachment holes 231 of the ground terminal block 23 can be selectively mounted with an attachable conductive pin 232, so that it can serve as a ground pin. In an alternative form, the grounding terminal block 23 can be pivotally connected with a pivotal ground pin 233 (see FIGS. 3 and 3A) stead of the attachable conductive pin 232. When the pivotal conductive pin 233 is not in use, it can be folded to lie on the base plate 11.

Furthermore, an indicating light 24 together with a resistance element 25, being electrically connected with the conductive terminal block 12, is provided in the cover 10 for indicating availability of electrical power. A first pusher 26 is provided for the first group of slots 13 and a second pusher 27, cooperating with the first pusher 26, is provided for the second group of slots 15.

In use, as shown in FIGS. 3, 3A, 4, 5, 6, and 6A through 6E, a user may choose the first conductive pins 17 or the second conductive pins 18, according to the type of a socket or receptacle, as the connecting pins, wherein the first conductive pins 17 can be applied to a European socket, whereas the second conductive pins 18 can be applied to a US socket. As described above, each of the first conductive pins 17 can be extended by its extension portion 171 for allowing the present adapter to be fitted to a socket requiring longer pins. Also, each of the first conductive pins 17 can be combined with an auxiliary element 19 for properly connecting to a socket having larger slots.

For safety reasons, some countries require a socket to contain a ground slot. Also, in British, a plug's earth pin, which can be plastic or metal, may only serve to open shutters over the live and neutral connections for electrical connection with the socket and to enforce the correct orientation of the live and neutral pins of the plug. In the present invention, the attachable conductive pin 232 or the pivotal conductive pin 233 can be inserted into the ground slot of a British socket to open the shutters thereof to achieve a proper connection. Furthermore, since the grounding terminal block 23 defines a plurality of engagement holes 231, each of which can engage a proper conductive pin, which allows the present invention to applied to sockets of various standards, such as Israel, Egypt, United States, Switzerland and Italy standards.

Figure 4:
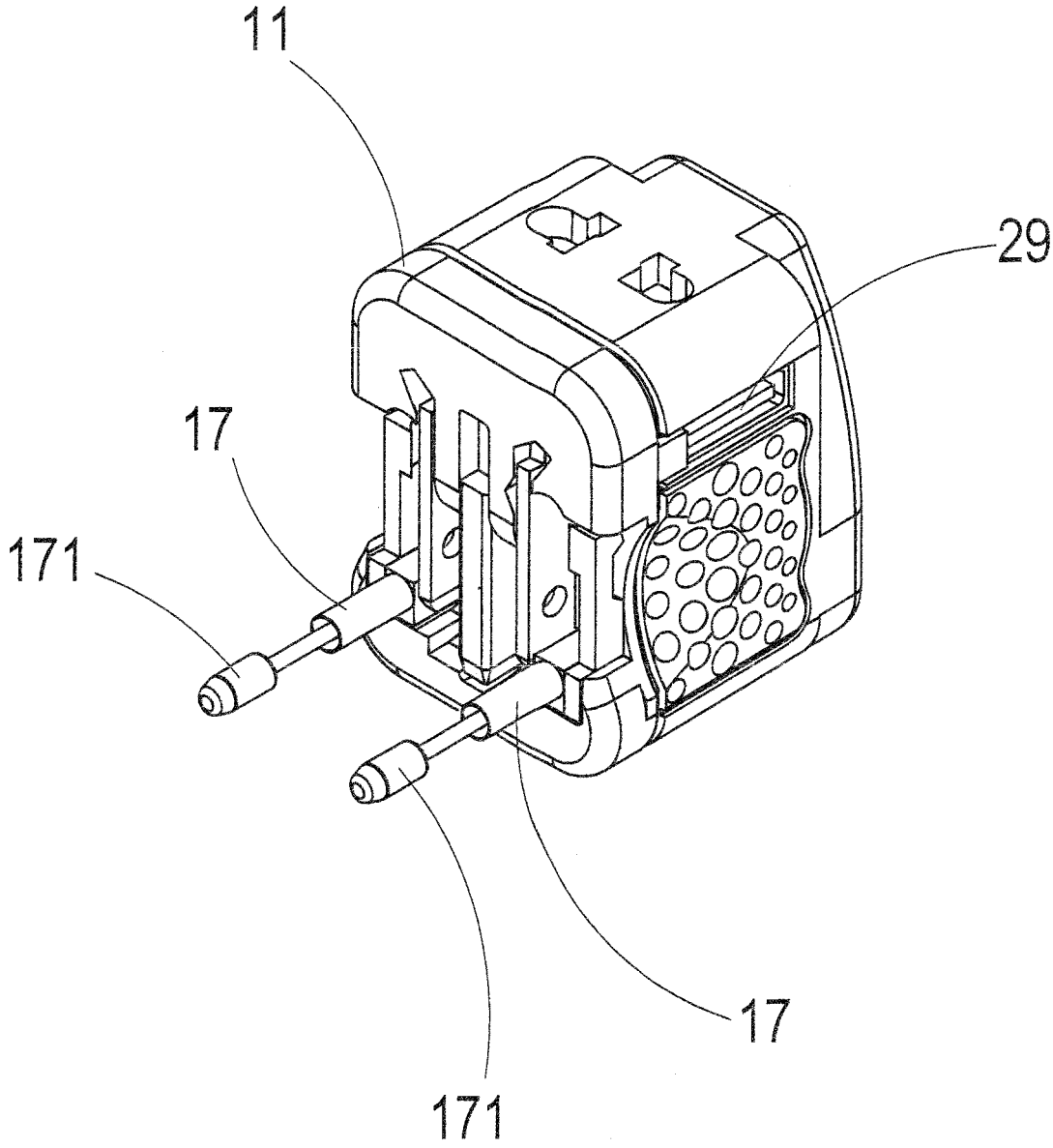
FIG. 4 shows a third application view of the embodiment of the present invention.
Figure 5:
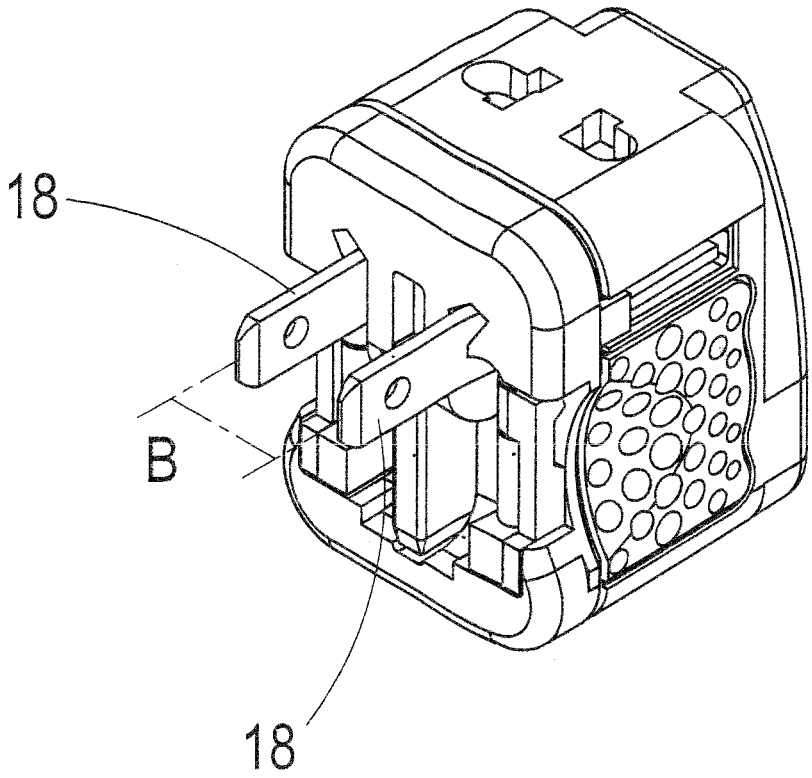
FIG. 5 shows a fourth application view of the embodiment of the present invention.

In addition, as shown in FIG. 4, the adapter of the present invention can be provided with a USB connection port 29, which can supply electrical power to electronic products.

FIGS. 7 and 7A show the operation of the first sliding assembly 14. With this feature, if an object other than a proper plug is inserted into one of the first group of slots 13, since the first sliding element 143 cannot compress the two springs 142 at the same time, so that the first sliding element 143 will incline toward one side of the cover 10. Therefore, the first sliding element 143 will get stuck and thus cannot be moved freely, thereby preventing a possible electrocution. On the other hand, if a proper plug is inserted into the first group of slots 13, two pins of the proper plug will allow the first sliding element 143 to compress the two springs 142 evenly, so that the sliding member 12 will not get stuck. Therefore, the plug can be electrically connected to the conductive terminal block 12 of the adapter.

Figure 8:
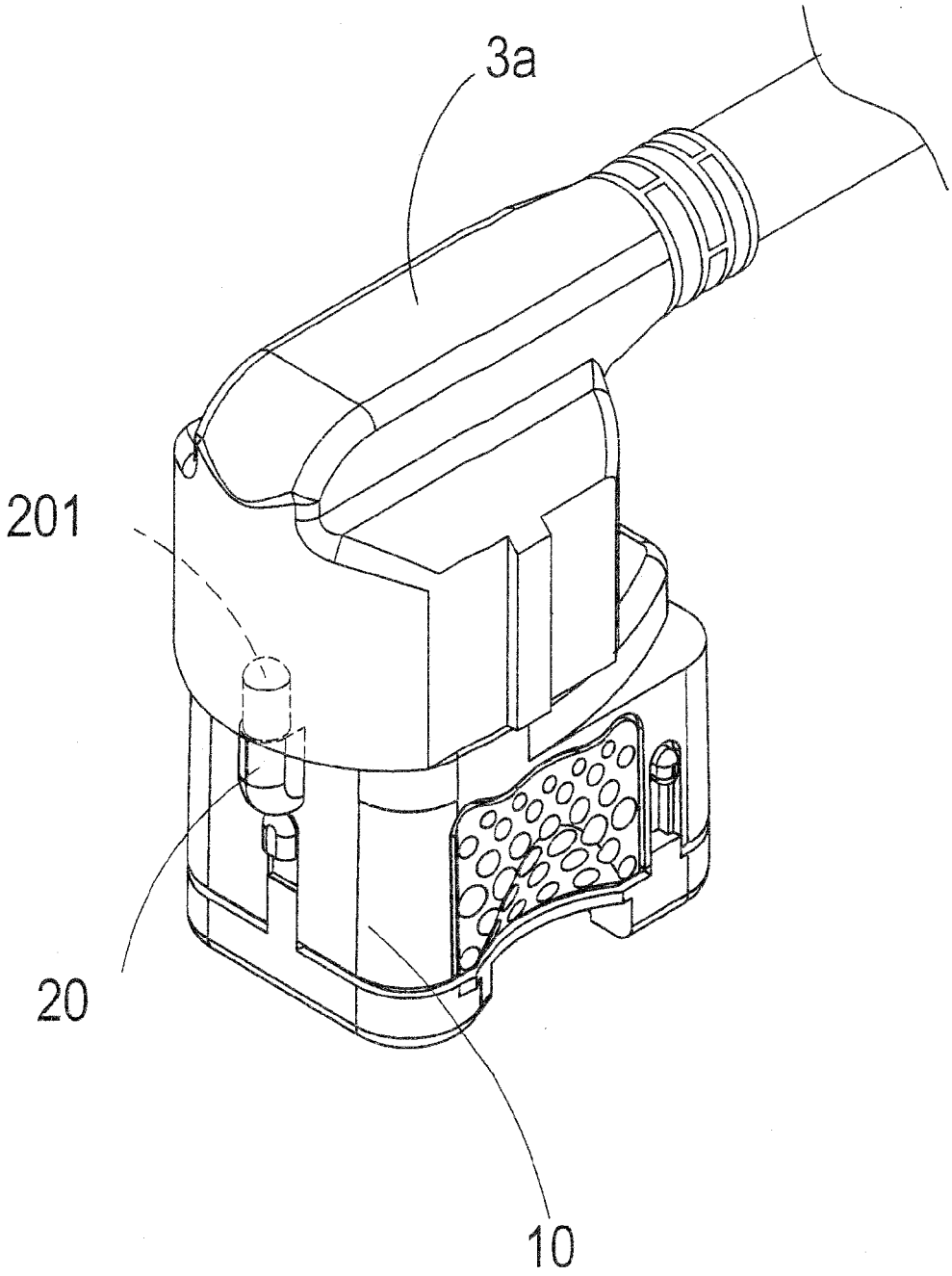
FIG. 8 shows a working view of the ground portion of the embodiment of the present invention.
Figure 9:
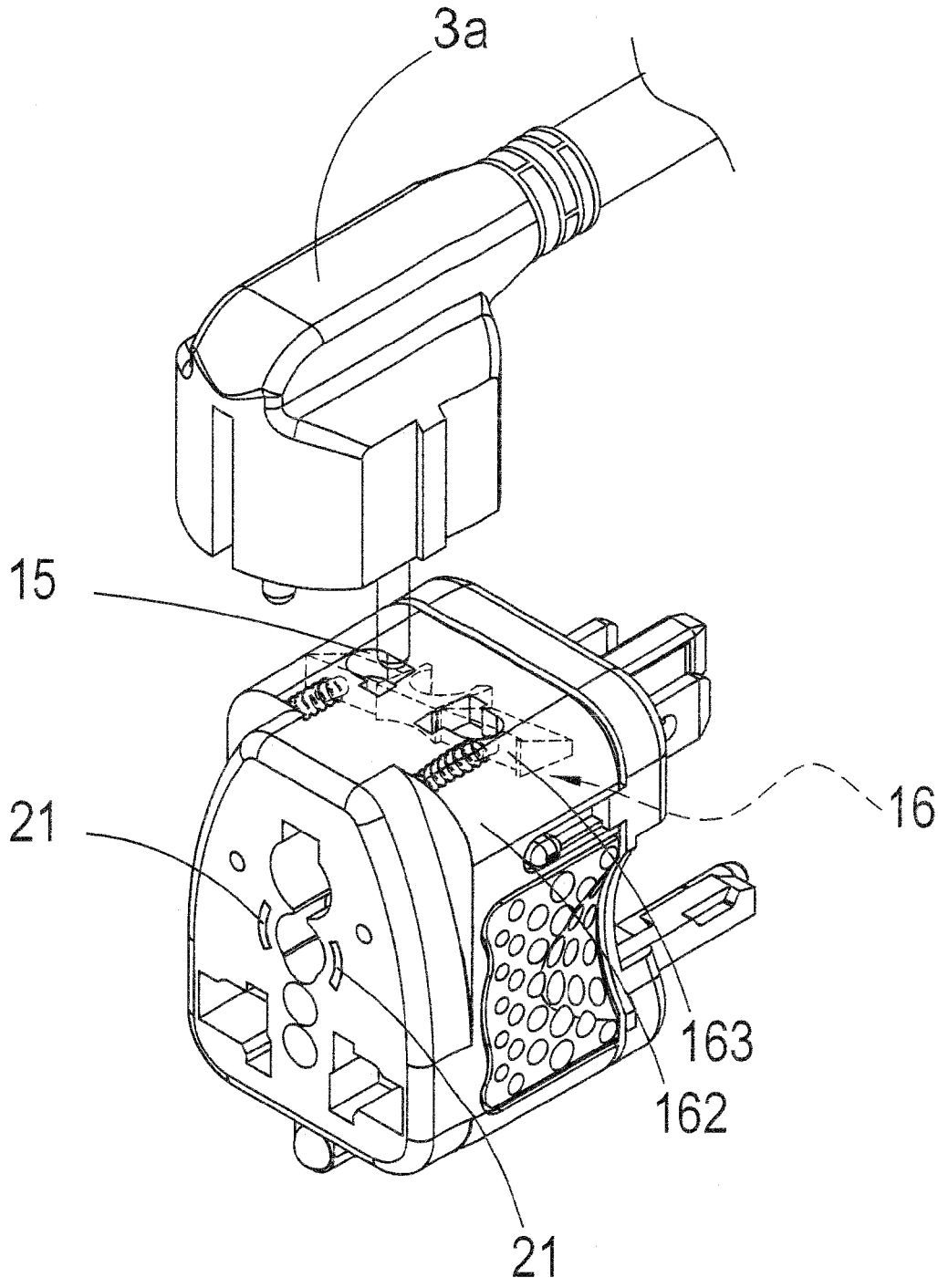
FIG. 9 shows a working view of the second sliding assembly of the embodiment of the present invention.
Figure 9A:
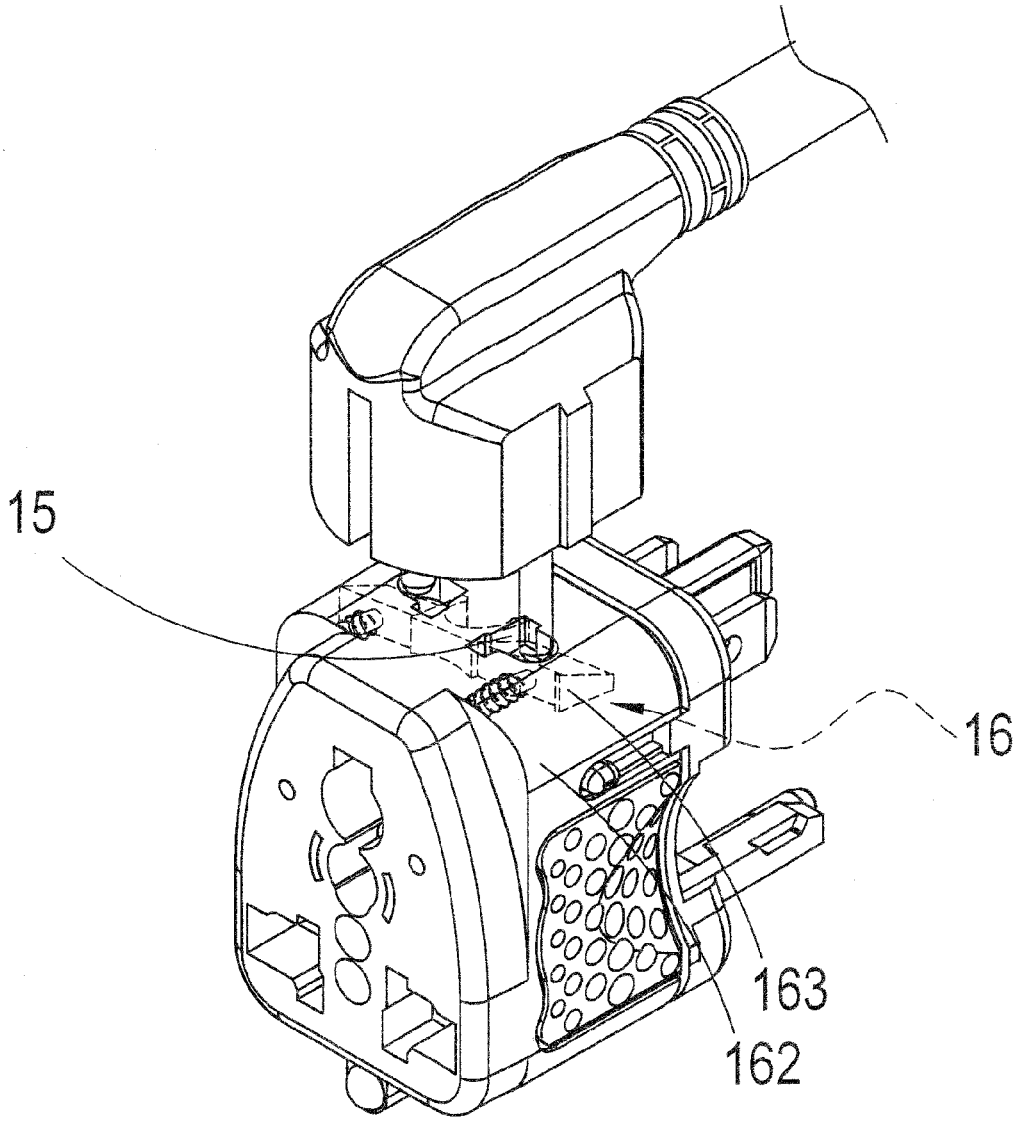
FIG. 9A shows another working view of the second sliding assembly of the embodiment of the present invention.

Similarly, as shown in FIGS. 9 and 9A, the second sliding assembly 16 performs the same function as the first sliding assembly 14, and thus a description therefor is omitted here. Also, as shown in FIG. 8, with the grounding portion 20, a plug 3*a* can be inserted into the adapter in two different orientations, either through the ground slot 21 or the ground portion 20. This feature may facilitate an electrical connection.

Although the present invention has been described with a certain degree of particularity, it is understood that the present disclosure is made by way of example only and the combination and arrangement of parts may be resorted to without departing from the spirit and scope of the invention hereinafter claimed.

We claim:

1. A safety plug adapter, comprising:

a cover defining a first group of slots on a top surface thereof and a second group of slots on a side surface, said first group of slots including a live slot, a neutral slot, and a ground slot, said second group of slots including a live slot and a neutral slot;

a base plate mated with said cover to form a housing;

a conductive terminal block mounted in said cover and including a grounding terminal corresponding to said ground slot of said first group of slots;

a first sliding assembly mounted in said cover, corresponding to said first group of slots, above said conductive terminal block;

a second sliding assembly mounted in said cover, corresponding to said second group of slots, beside said conductive terminal block;

two first conductive pins pivotally mounted at said base plate;

two second conductive pins movably mounted at said base plate opposite to said first conductive pins;

two auxiliary elements provided at said base plate for being selectively combined with said first conductive pins to increase their cross dimensions;

a grounding portion formed on said cover in addition to said ground slot of said first group of slots, said ground portion being electrically connected to said grounding terminal of said conductive terminal block;

a grounding terminal block mounted at said base plate and defining a plurality of attachment holes, said grounding terminal block being electrically connected to said grounding terminal of said conductive terminal block;

an attachable conductive pin selectively mounted to one of said attachment holes of said grounding terminal block to be served as a ground pin;

whereby said first group of slots or said second group of slots can be inserted by a plug of an electrical device, whereas said first conductive pins or said second conducive pins can insert into a socket with a selective cooperation of said attachable ground pin, to achieve an electrical connection between the electrical device and the socket.

2. The safety plug adapter of claim 1, wherein said first sliding assembly includes a base element fixedly mounted in said cover, a sliding element slidably mounted in said cover, and two springs symmetrically connected between said base element and said sliding element, whereby said sliding member can be normally biased by said springs to close the live slot and the neutral slot of said first group of slots.

3. The safety plug adapter of claim 1, wherein said second sliding assembly includes a base element fixedly mounted in said cover, a sliding element slidably mounted in said cover, and two springs symmetrically connected between said base element and said sliding element, whereby said sliding member can be normally biased by said springs to close the live slot and the neutral slot of said second group of slots.

4. The safety plug adapter of claim 1, wherein an indicating light together with a resistance element, being electrically connected with said conductive terminal block, is provided in said cover for indicating availability of electrical power; a grip portion is provided on two opposite sides of said cover for facilitating a user to take the adapter.

5. The safety plug adapter of claim 1, wherein said conductive terminal block includes a live terminal and a neutral terminal.

6. The safety plug adapter of claim 1, further comprising a first pusher for said first group of slots and a second pusher for said second group of slots.

7. The safety plug adapter of claim 1, wherein each of said second conductive pins is formed into an angled pin.

8. The safety plug adapter of claim 1, wherein each of said first conductive pins is provided with an extension portion for increasing the length of each conductive pin.

9. The safety plug adapter of claim 1, wherein a pushing element is provided in said cover for pushing said second conductive pins to extend out of said base plate for connecting to a socket.

* * * * *